US006612874B1

(12) United States Patent
Stout et al.

(10) Patent No.: US 6,612,874 B1
(45) Date of Patent: Sep. 2, 2003

(54) ROTATING CONNECTOR ADAPTER WITH STRAIN RELIEF

(75) Inventors: Gary H. Stout, Farmington, UT (US); Ryan A. Kunz, Roy, UT (US)

(73) Assignee: 3Com Corporation, Santa Clara, CA (US)

( * ) Notice: Subject to any disclaimer, the term of this patent is extended or adjusted under 35 U.S.C. 154(b) by 0 days.

(21) Appl. No.: 09/884,543

(22) Filed: Jun. 19, 2001

Related U.S. Application Data

(63) Continuation-in-part of application No. 09/657,495, filed on Sep. 8, 2000.

(51) Int. Cl.[7] ..... H01R 25/00

(52) U.S. Cl. ..... 439/640; 439/11; 439/13; 439/638

(58) Field of Search ..... 439/11, 13, 640, 439/586, 162, 923, 447, 638

(56) References Cited

U.S. PATENT DOCUMENTS

| | | | | |
|---|---|---|---|---|
| 3,912,352 | A | * 10/1975 | Kinnear | 339/8 |
| 4,405,877 | A | * 9/1983 | Haraden et al. | 313/318 |
| 4,542,858 | A | * 9/1985 | Manges | 242/54 |
| 4,583,084 | A | * 4/1986 | Henderson et al. | 128/846 |
| 4,875,871 | A | * 10/1989 | Booty et al. | 174/72 C |
| 5,090,916 | A | * 2/1992 | Magnier | 439/299 |
| 5,352,122 | A | * 10/1994 | Speyer et al. | 439/13 |
| 5,462,457 | A | * 10/1995 | Schroepfer et al. | 439/344 |
| 5,466,172 | A | * 11/1995 | Carstens et al. | 439/502 |
| 5,494,457 | A | * 2/1996 | Kunz | 439/344 |
| 5,499,923 | A | 3/1996 | Archibald et al. | 439/26 |
| 5,562,463 | A | * 10/1996 | Tan | 439/502 |
| 5,588,843 | A | * 12/1996 | Sobhani | 439/22 |
| 5,628,634 | A | * 5/1997 | Omata | 439/13 |
| 5,634,802 | A | 6/1997 | Kerklaan | 439/131 |
| 5,816,848 | A | * 10/1998 | Zimmerman | 174/69 |
| 6,089,874 | A | * 7/2000 | Kroulik et al. | 439/11 |
| 6,109,926 | A | * 8/2000 | Blum et al. | 439/3 |
| 6,164,989 | A | 12/2000 | Glad et al. | 439/131 |
| 6,186,796 | B1 | * 2/2001 | Wedge | 439/11 |
| 6,375,487 | B1 | * 4/2002 | Tennessen | 439/373 |

FOREIGN PATENT DOCUMENTS

| | | | |
|---|---|---|---|
| GB | 2031233 A1 | * 8/1978 | H04R/13/14 |

* cited by examiner

*Primary Examiner*—P. Austin Bradley
*Assistant Examiner*—Edwin A. León
(74) *Attorney, Agent, or Firm*—Workman, Nydegger & Seeley

(57) ABSTRACT

A connector adapter that can be used to directly connect a peripheral device to a host device. The connector adapter is adjustable so as to allow selective reorientation of the peripheral with respect to the host device. The connector adapter includes a limiting mechanism that restricts the degree to which the adapter can be selectively rotated. In addition, the adapter includes an indexing mechanism that allows the position of the adapter to be locked in predetermined positions. In one embodiment, the connector adapter is partially formed from a compliant material so that the adapter can bend when submitted to an external force, and thereby resist breakage. The connector adapter may also have a physical geometry that provides additional strain relief, such as a plurality of serrations formed on the outer surface. An extension spring can be positioned within the connector adapter so as to return the adapter to substantially its original shape when the external force is removed.

16 Claims, 11 Drawing Sheets

Fig. 1

ROTATING CONNECTOR ADAPTER WITH STRAIN RELIEF

RELATED APPLICATION INFORMATION

This application is a continuation-in-part of U.S. patent application entitled "Rotating Connector Adapter," filed on Sep. 8, 2000 and having U.S. Ser. No. 09/657,495. That application in incorporated by reference herein in its entirety.

BACKGROUND OF THE INVENTION

1. Field of the Invention

The present invention relates generally to connectors for interfacing peripherals to a host device. More specifically, the present invention relates to an adapter configuration that permits a peripheral device to be electrically connected to a host device interface, in any one of a number of physical positions relative to the host interface, and that is resistant to breakage.

2. Description of Related Art

While today's computers incorporate an increasing amount of functionality within the physical constraints of the computer itself, there are a number of functions that can only be provided by way of an add-on, external peripheral. For instance, joysticks, scanners, digital cameras, wireless network antennas, are all examples of devices that may have to be operatively (i.e., electrically and physically) connected to a host device, such as a computer.

In the past, connecting such peripheral devices to a host involved a fairly complicated process. A user was required to identify the correct interface port and cable, and then properly configure the host and the peripheral device to insure compatible communications between the two devices. The process was often difficult, required a fairly high level of computer expertise, and was often subject to error. In addition to such installation complexities, traditional connection schemes also suffered from other problems as well, such as limited performance capabilities.

Consequently, the computer industry has developed interface schemes that seek to address these and other problems. One such interface scheme is known as the Universal Serial Bus (USB) specification, which defines a connection environment that allows for the connection of computers and peripherals of the sort described above. USB provides several advantages. From a performance standpoint, it allows for a much higher level of data transfer between the peripheral device and the host device.

Further, USB reduces the complexity of connecting a peripheral to a host. Generally, a USB-compliant peripheral can be connected directly to a USB-compliant host, and there is no need for the user to manually configure either of the two devices—the USB environment essentially automates the underlying configuration process in a manner that is transparent to the user.

The USB specification defines the physical design, dimensions, and electrical interface of peripheral devices using a "keyed" connector protocol. In general, the USB standard defines a single USB plug type, that is electrically and physically received by a similarly defined USB port or receptacle. Thus, a peripheral device vendor may provide the user with a cable having a USB plug, that can be physically and electrically received within a USB port on the host device.

USB connectors utilize a fixed orientation with respect to the receptacles for receiving the plugs on the host and peripheral device. Unfortunately, the fixed orientation of the receptacle on the host device is not standardized from one manufacturer to another. As such, a USB plug must be physically oriented in a manner dictated by the host USB receptacle. For example, USB series "A" receptacles can be found on current notebook computers in all of four possible 90-degree orientations. This can be problematic in situations where a USB peripheral must have a specific physical orientation vis-à-vis the host USB receptacle. Solutions include the use of a cable, or a peripheral that is jointed in a manner so as to allow re-orientation of the peripheral. However, such approaches have not been entirely satisfactory. Use of a cable requires another attachment component that is subject to failure and increases attachment complexity. Moreover, a cable does not allow for direct connection of the peripheral to the host. Also, providing a peripheral with multiple joints increases cost and manufacturing complexity of the peripheral.

The need for providing a known, fixed orientation of a peripheral device with respect to a host is especially critical for certain types of peripherals. For example, an antenna for providing wireless data communication requires a certain orientation so as to provide optimal transmission and reception of wireless signals. While the use of USB-based connection schemes are ideal for such antennas from a performance and ease-of-use standpoint, a USB connector may not provide the optimal physical orientation.

Thus, it would be an advance over the present state of the art to provide a connection scheme that provides the advantages of the USB standard, but that allows the peripheral to be physically reoriented with respect to the host device.

In addition to problems associated with the inability to freely orient a peripheral device, existing connection schemes have other drawbacks as well. Often, a peripheral is connected in a fixed and rigid manner to the host port, and often in a manner such that the peripheral and connector extend outward from the host. Consequently, the connector and/or peripheral are vulnerable to breakage if they are subjected to an external force. This problem is particularly acute when a peripheral is connected to a mobile host device, such as a laptop computer. Movement of the host device can often result in forces being applied to the peripheral/connector, which can break or damage the peripheral.

Consequently, it would be an advance over the present state of the art to provide a connection scheme that is resilient, and less subject to breakage and/or damage when connected to a host device and subjected to external forces. Preferably, the connection scheme would possess some level of strain relief so it is less prone to damage if it is bent or twisted.

SUMMARY OF PRESENTLY PREFERRED EMBODIMENTS

The present invention has been developed in response to the current state of the art, and in particular, in response to these and other problems and needs that have not been fully or completely solved by currently available connector schemes for interfacing peripheral devices with host devices. Thus, it is an overall object of the present invention to provide a reliable, reorienting connection between the attached peripheral device and the host device. Further, it is an objective to provide the connection without the use of a flexible cable; instead, it is an objective to provide a direct and fixed connection between the host and the peripheral. A related object is to provide a reorientation scheme that allows the peripheral to placed in a desired physical orientation with respect to the host, irrespective of the orientation of the interface on the host. For example, if the host interface is a vertical USB receptacle, or a horizontal USB receptacle, it is an objective to allow the peripheral to remain in the same desired position. Moreover, it is an objective to provide a direct connection, but at the same time provide a connection that is resilient to external forces, thereby minimizing breakage or damage to the connector if it is inadvertently exposed to an external force when connected to the host.

To summarize, these and other objectives have been addressed by embodiments of the present invention, which is directed to a connector adapter scheme that allows a peripheral device to be directly connected to a host device having a connector interface. Moreover, the connector adapter is adjustable, so that the relative position of the connected peripheral can be adjusted. This allows, for example, the peripheral to be maintained in a desired position, irrespective of the physical orientation of the host connector interface.

In a presently preferred embodiment, the connector adapter includes a host connector interface, that is capable of electrically and physically interfacing with an interface connector provided on a host device. For example, the host connector may be a USB-type plug, that can interface with a USB-type receptacle provided by the host device. The adapter also includes a peripheral interface, that is capable of providing a detachable electrical connection with a peripheral device, such as a wireless antenna. This can be a proprietary connector scheme, or could be provided with a standardized connector.

Disposed within a housing of the connector adapter is an electrical interconnection that provides the appropriate signal connection between the host connector and the peripheral interface. In a presently preferred embodiment, this interconnection is provided by way of a series of flexible wires. The number and types of signal interconnections provided will typically depend on the type of connectors involved, as well as the type of peripheral being used.

The connector adapter is further constructed to allow the host connector interface portion of the adapter to assume any one of a number of physical orientations. In a preferred embodiment, this is accomplished by interconnecting the peripheral interface section with the connector adapter in a manner such that it is selectively moveable, and preferably rotatable with respect to the rest of the adapter. In this way, the relative position of the peripheral device can be maintained in a desired position, irrespective of the physical orientation of the interface presented by the host device.

In a presently preferred embodiment, the connector adapter also includes means for limiting the degree to which the peripheral interface can be rotated. This prevents excessive twisting and breakage of the internal wire connections. By way of example, the preferred embodiment restricts rotation of the connector adapter to a range of 270°, although other ranges could also be provided.

Preferred embodiments of the present invention also allow the connector adapter to be rotated in to specific "locked" positions. For example, in one embodiment, the locked positions are oriented at 90° orientations, which corresponds to typical physical orientations of the interface provided on a host device. Further, when selectively rotated to a predetermined position, the mechanism provides a tactile indication to the user.

In yet another presently preferred embodiment, at least a portion of the connector adapter is formed to provide strain relief, and thus provide some resilience to external bending forces. Preferably, the strain relief is provided in a manner so that the connector adapter can be subjected to a bending force, and be displaced a predetermined distance from the connection axis without breaking, and without interrupting any electrical connection between the host and the peripheral. In one preferred embodiment, this feature is provided by forming at least a portion of the connector adapter housing from a resilient material. Further, the housing may be formed with a physical geometry that further provides strain relief. For example, the housing may be formed with serrations that allow the housing to bend in any particular direction without breaking, and that minimizes stresses experienced along the length of the housing. Further, to insure that the housing returns to its original position once the bending force is removed, preferred embodiments will include means for reorienting the position of the connector adapter housing, such as an internal extension spring or the like. This embodiment provides the advantages of a fixed connector scheme, but also eliminates certain of the problems otherwise associated with such connector, namely fragility.

Additional objectives, advantages and features of the present invention will be set forth in the description which follows, and in part will be obvious from the description, or may be learned by the practice of the invention.

BRIEF DESCRIPTION OF THE DRAWINGS

In order that the manner in which the above recited and other advantages and objects of the invention are obtained, a more particular description of the invention briefly described above will be rendered by reference to specific embodiments thereof, which are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF THE PREFERRED EMBODIMENTS

In general, embodiments of the present invention are directed to a connection system and adapter that allow a peripheral to be connected directly to a host interface. Moreover, regardless of the physical orientation of the host interface, the connector adapter provides a degree of adjustability that permits the peripheral to be oriented in a desired physical position relative to the interface and the host device. Thus, the peripheral can be oriented in a desired position, regardless of the physical orientation of the host interface. In addition, preferred embodiments provide a connector adapter having strain relief along its length, so as to minimize any breakage or damage to the adapter.

Figure 1:
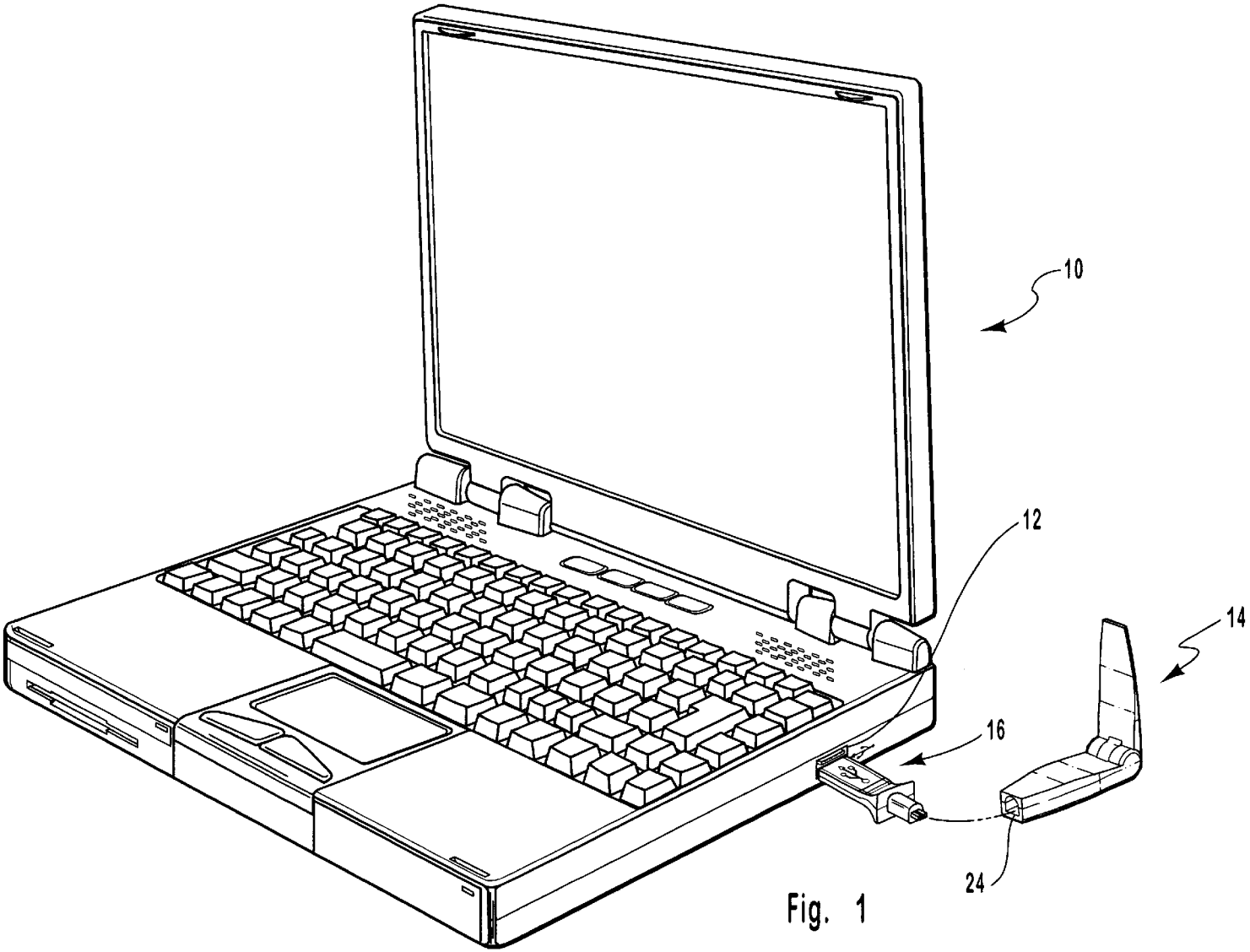
FIG. 1 illustrates an exemplary host system having a USB-type receptacle for interfacing with a USB-type plug provided on an exemplary peripheral having a rotatable connector adapter constructed in accordance with principles of the present invention.

FIG. 1 is illustrative of the sort of environment that embodiments of the present invention find particular applicability. That figure shows a host device, such as a portable computing device 10, that is equipped with an interface port, such as USB receptacle 12. As is well known, the USB receptacle 12, when implemented in accordance with USB standards, provides a standardized electrical and physical interface that allows external peripherals to be operatively interfaced with the host computer device 10. The USB receptacle 12 illustrated in FIG. 1 also has a particular physical orientation, which in turn dictates the orientation of the USB plug when it is operatively received therein. As noted above, the orientation of the USB receptacle can vary from host device to host device. As such, the orientation of the plug must be rotated in a manner that corresponds to the receptacle orientation. This is problematic in the event that the peripheral, illustrated as a wireless communication antenna device 14 in FIG. 1, must be maintained in a particular physical orientation. For example, the antenna 14, to achieve optimal operating conditions, must preferably be in a vertically polarized position. If the antenna were interfaced with the host 10 via a fixed USB plug, then this may not be possible in the event that the host USB interface 12 is oriented in a different manner.

This problem is addressed by way of a connector adapter, one presently preferred embodiment of which is designated generally at 16 in FIG. 1. In general, the connector adapter 16 provides the physical and electrical interface between the USB receptacle 12 of the host, and the peripheral device, such as the wireless antenna 14. Moreover, as will be described in further detail below, the operative connection is provided in a manner such that, regardless of the physical orientation of the USB receptacle 12, the connector adapter 16 can be rotated so that the peripheral can be maintained in a single preferred physical position.

Figure 3:
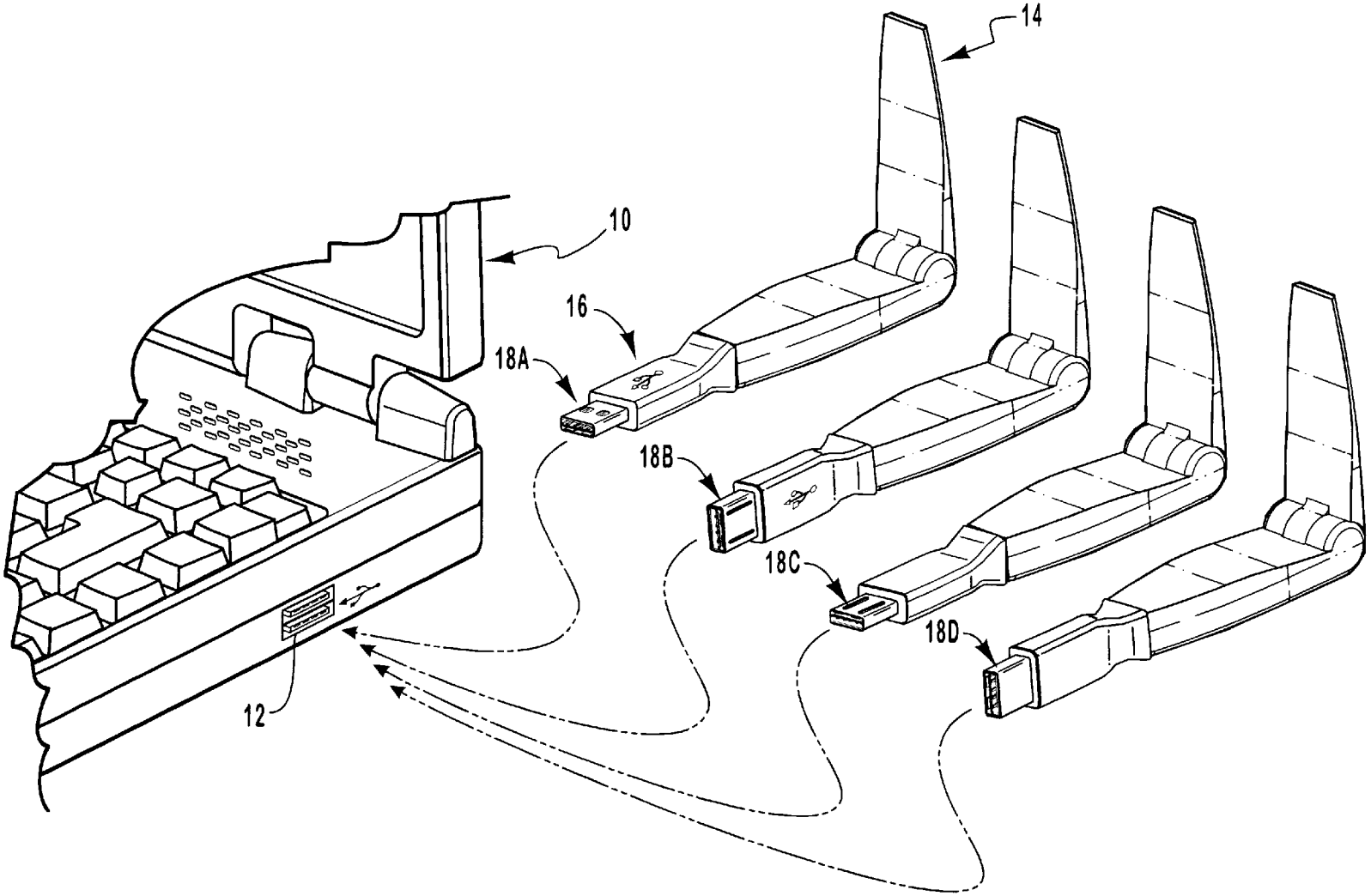
FIG. 3 illustrates a series of perspective views of a connector adapter presenting a USB plug in four different physical orientations so as to maintain a peripheral device in a single desired physical orientation with respect to a host device USB-type receptacle.

This ability to rotate, and thereby maintain the peripheral in a single preferred position, is best seen in FIG. 3. As is shown there, the connector adapter includes a USB plug portion 18 for interfacing with the corresponding USB receptacle 12 on the host. The rotational capability of the connector adapter 16 permits the plug 18 to be positioned in a plurality of different orientations, depending on the orientation of the host receptacle 12. In the illustrated embodiment, four discrete positions, 18A–18D are shown. Thus, regardless of the horizontal or vertical orientation of the receptacle 12, the physical orientation of the peripheral, such as antenna 14, need not vary.

Figure 2:
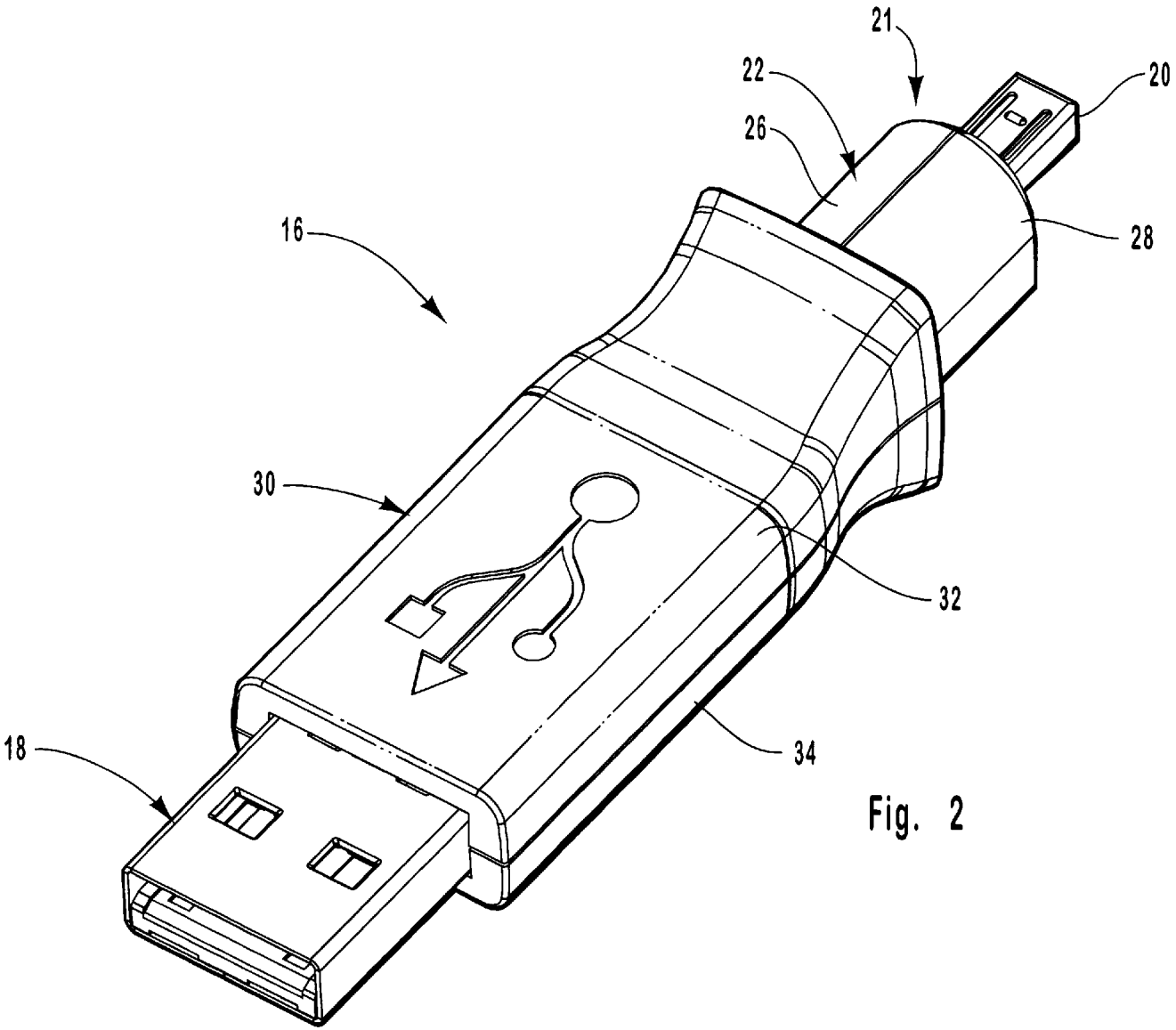
FIG. 2 is a perspective view of one presently preferred embodiment of a connector adapter constructed in accordance with the teachings of the present invention.
Figure 7:
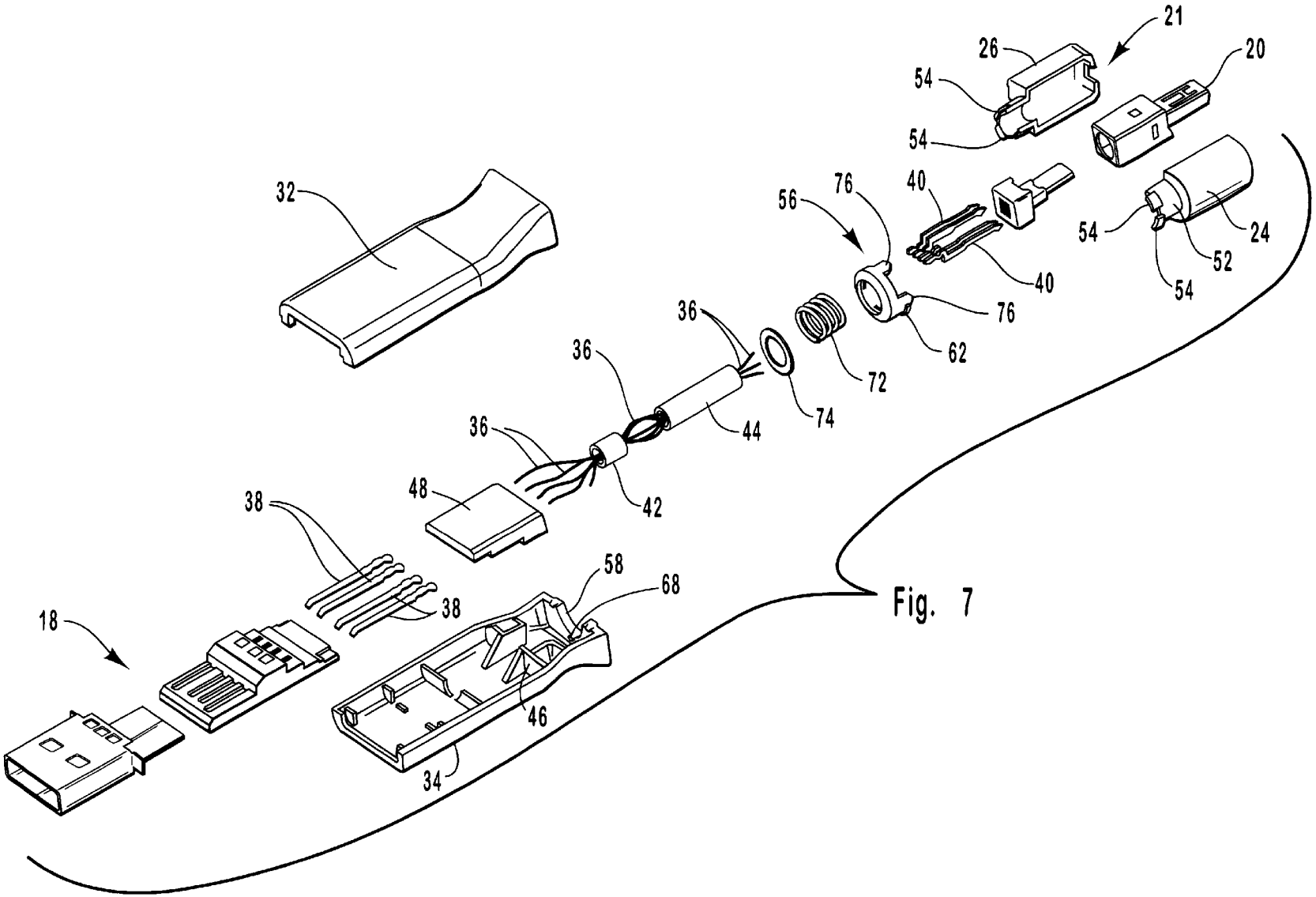
FIG. 7 is an exploded perspective view of one presently preferred embodiment of a connector adapter.

Referring now to FIG. 2, a presently preferred embodiment of the connector adapter 16 is shown. As is shown, the adapter 16 includes a host interface, which in the illustrated embodiment is a USB-compliant plug 18. The adapter also includes a peripheral interface, shown at 21, which is any suitable connector that is capable of providing an electrical and physical interface with the corresponding peripheral. In the illustrated embodiment, the peripheral interface 21 is comprised of a D-shaped outer cover 22 that is preferably comprised of two mated side portions 26, 28, as can also be seen in FIG. 7. The D-shaped outer cover 22 is sized and shaped so as to be operatively received within a corresponding recess 24 that is formed in the peripheral, such as is shown in antenna 14 in FIG. 1. In the illustrated embodiment, the peripheral interface further includes an electrical plug 20, that is adapted to interface with a complementary electrical connector (not shown) disposed within the recess 24 of the peripheral antenna 14 device. It will be appreciated that while the peripheral interface 21 is described and illustrated as having the configuration of FIG. 2, that any suitable electrical connector scheme could be used, depending on the connection interface requirements of the particular peripheral involved. For example, the interface 21 could be comprised of a standard connector scheme, and could even be another USB-type connector interface.

With continued reference to FIG. 2, in a presently preferred embodiment the connector adapter 16 is further comprised of an outer housing 30, constructed of plastic or any other suitable material. The housing 30 could be formed from single integral piece, or, as in the illustrated embodiment, from multiple pieces, such as top 32 and bottom 34 portions. In an alternative embodiment, the housing 30 may be constructed of a flexible material, such as rubber or a similarly resilient material, so as to provide a level of strain relief along the length of the adapter. In this type of embodiment, the connector adapter would be less subject to breakage when attached to the host system.

In a presently preferred embodiment, the host interface (i.e., USB plug 18) is held in a fixed relationship with respect to the housing 30. On the other hand, the peripheral interface 21 is interconnected with the housing 30 portion in a manner so as to permit selective movement and reorientation of the peripheral interface 21 with respect to the housing 30. In the preferred embodiment, the interconnection is provided so that the peripheral interface 21 can rotate with respect to the housing 30. This allows reorientation of the plug 18 to accommodate different USB receptacle orientations, and allows a fixed position of the peripheral interface 21 and corresponding peripheral device, such as antenna 14—as for example is shown in FIG. 3. It will be appreciated however that the rotational interconnection could be provided anywhere along the axis of the connector adapter 16 so as to achieve the same purpose. For example, the host interface portion 18 could have the rotational inter-connection with respect to the rest of the housing, and the peripheral interface a fixed connection. Alternatively, multiple rotation points could be implemented along the axis of the adapter 16. For example, both the peripheral interface 21 and the host interface 18 could be rotationally interconnected with the housing.

Figures 4, 4A:
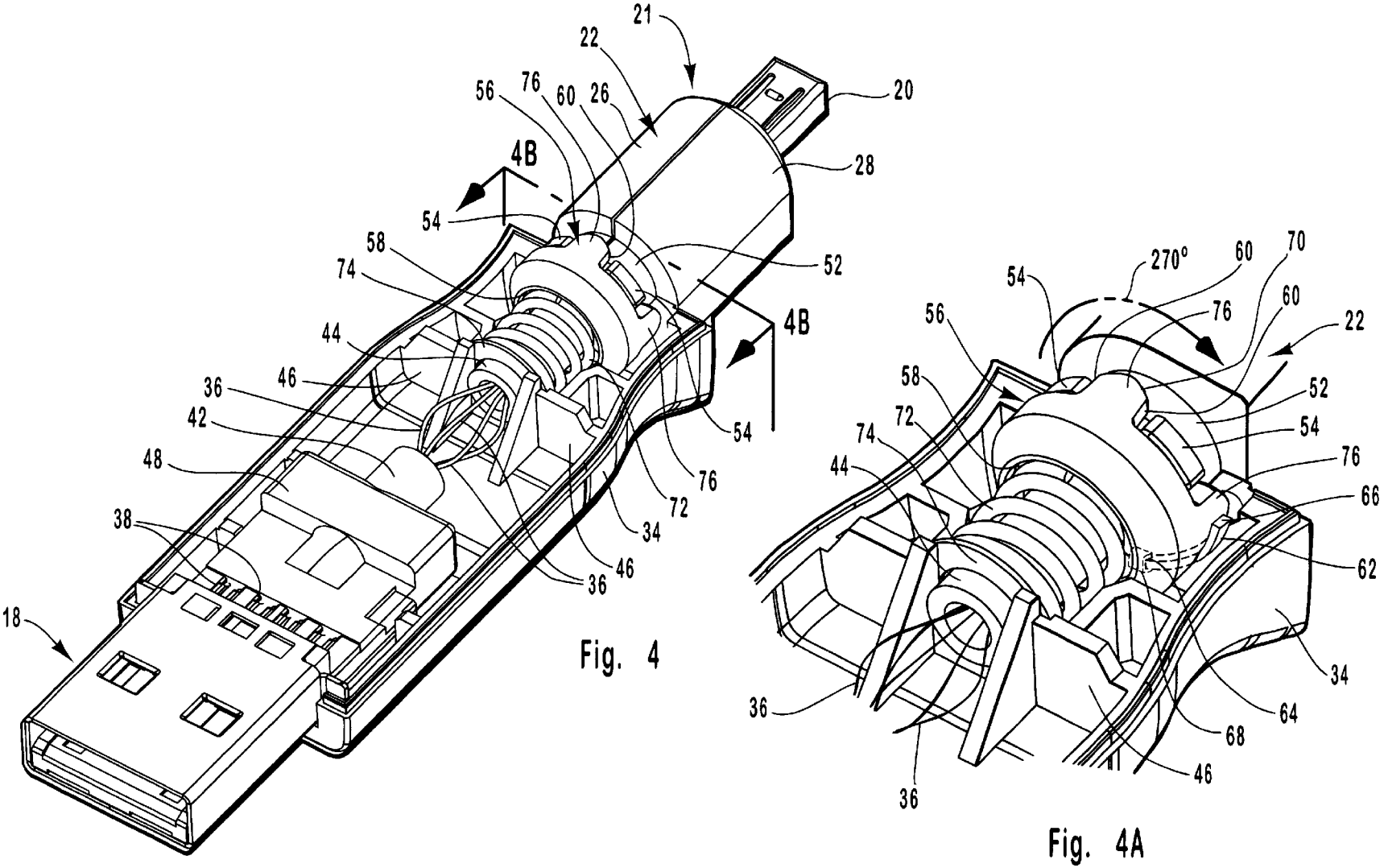
FIG. 4 is a perspective view of a partially assembled exemplary connector adapter.
FIG. 4A is a perspective view showing additional details of the connector adapter of FIG. 4.
Figure 5:
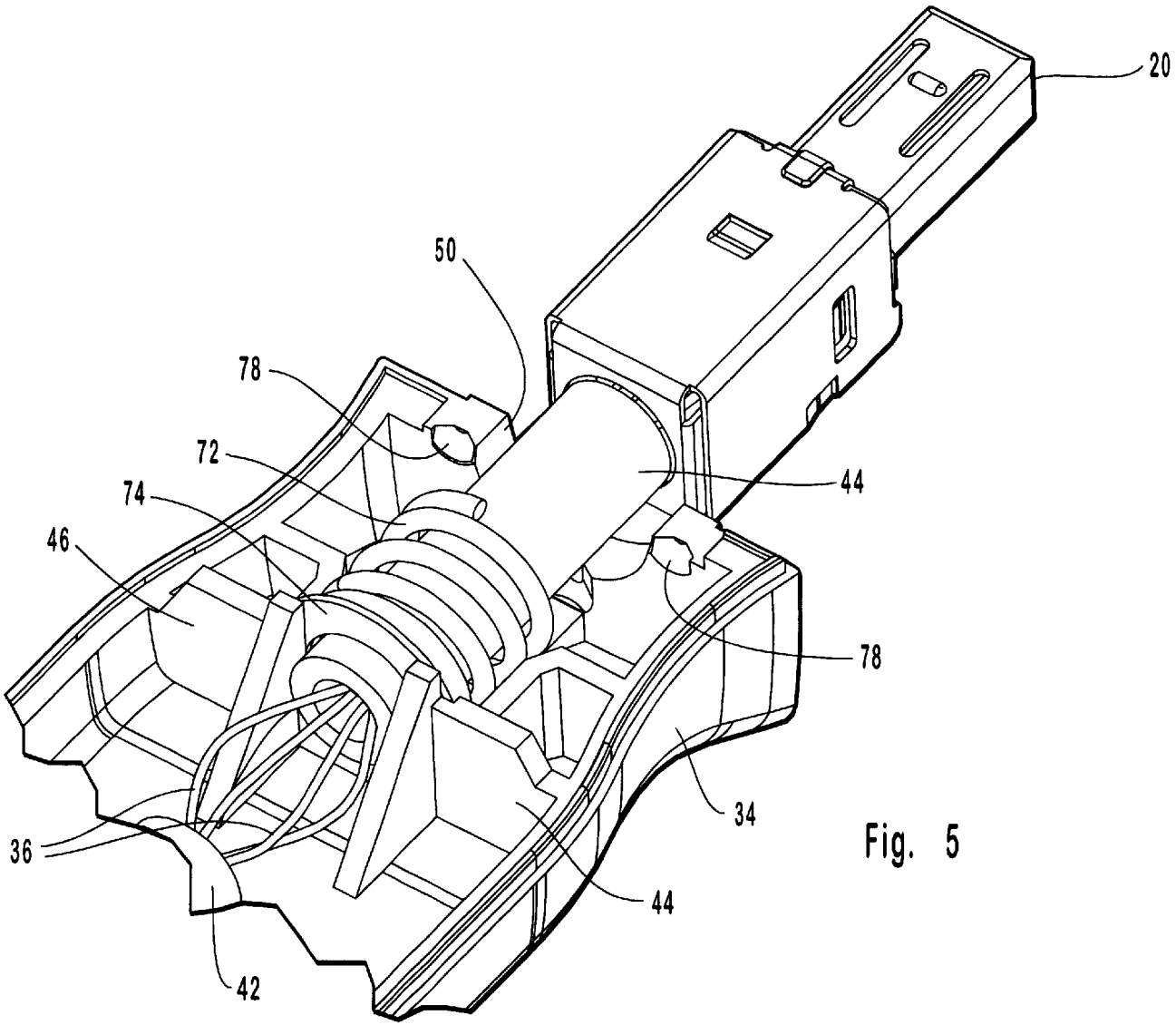
FIG. 5 is a perspective view of a portion of the connector adapter of FIG. 4.
Figure 6:
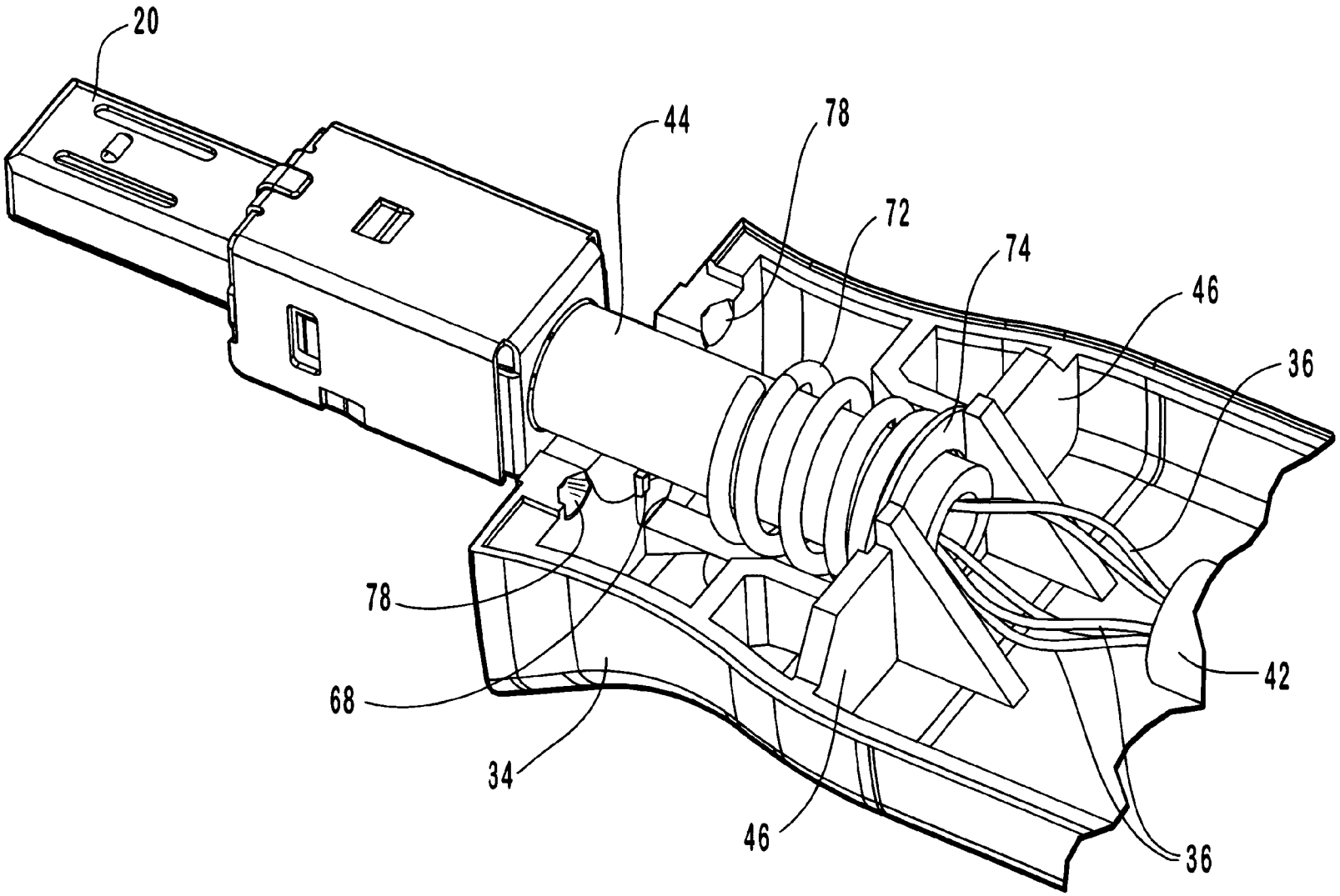
FIG. 6 is a perspective view of a portion of the connector adapter of FIG. 4.

Reference is next made to FIGS. 4 and 4A together, which illustrate additional details of a presently preferred embodiment of the connector adapter 30. As can be seen with the top cover 32 of the housing removed, the housing 30 forms an internal cavity, within which is disposed the appropriate electrical interconnection means between the host interface 18 and the peripheral interface 21. In the illustrated embodiment, the electrical interconnection is provided by way of an appropriate number of wires 36, that interconnect the electrical contacts 38 of the host interface 18 (USB plug), and the electrical contacts 40 (FIG. 7) of the peripheral interface 21. Again, the number of wires and interconnection scheme will be dictated by the types of connectors used, and the peripheral being used. Preferably, the wires 36 are at least partially disposed within a cylindrical wiring harness, shown as two portions 42 and 44. Further, the wiring harness 42, 44 is preferably held substantially fixed within the cavity by any appropriate means, such as support ribs 46, over-molded portion 48, or any other suitable retention scheme. The wiring harness 44 extends through an access hole 50 formed at one end of the housing 30, as can best be seen in FIG. 5, and is appropriately secured to the peripheral interface 21. It will be appreciated that in the event that the housing is constructed of a resilient/flexible material, as noted above, the support ribs 46 may have a different configuration so as to provide a sufficient level of support to the adapter, and yet allow a level of flexibility. In alternative embodiments, the spring 72 (discussed below) may be provided with a longer length, so as to provide further structural support to a flexible adapter.

In a preferred embodiment, the access hole 50 of the housing 30 receives a stepped-down cylindrical end 52 of the D-shaped housing 22. Formed on the periphery of this cylindrical end 52 are a plurality of locking nubs 54. With the top and bottom covers 32, 34 assembled with the end 52 received within the access hole 50, the size of the locking nubs 54 prevent retraction of the D-shaped housing 22 from the access hole 50. This notion is also seen in the cross-sectional views of FIGS. 4B–4D. In this way, the peripheral interface 21 is allowed to freely rotate with respect to the rest of the connector adapter 16 housing 30.

It will be appreciated that in the preferred embodiment, unlimited rotation of the peripheral interface 21 could result in the twisting—and ultimate breakage—of one or more of the wires 36. As such, in one presently preferred embodiment, the connector adapter includes means for preventing over-rotation of the peripheral interface 21. In this way, the connector adapter can only be rotated to a predetermined rotational position in one direction, which in the preferred embodiment is 270° (as is shown in FIG. 3), thereby preventing any over-twisting and breakage of the internal wires 36.

By way of example and not limitation, the over-rotation prevention means is implemented with a dial index 56. As can be seen in FIGS. 4 and 4A, the dial index 56 has a bore 58 through which the wiring harness 44 and associated wires 36 are passed to the peripheral interface 21. The dial index 56 has formed therein locking recesses 60, which are sized and shaped so as to receive and engage the locking nubs 54 of the cylindrical end 52 of the cover 22. The locking engagement of the index 56 with the cylindrical end 52 is maintained by way of a biasing means, such as the spring 72 and washer 74 which bias the index 56 so as to engage with the end 52. Thus, rotation of the peripheral interface 21 results in a corresponding rotation of the dial index 56.

Also formed on the periphery of the dial index 56 is a ridge 62 having a first abutment edge 64 and a second abutment edge 66, which can be seen in FIGS. 4A–4D. The ridge 62 is sized and shaped so as to prevent over-rotation of the dial index 56 and peripheral interface 21. While any degree of rotation could be selected, in the preferred embodiment, the rotation is limited to the 270° mentioned above. The rotation is limited via placement of a stop surface 68, which in the preferred embodiment is placed on an interior surface of the housing 30 (FIGS. 4A–4D and FIG. 6).

Figure 4D:
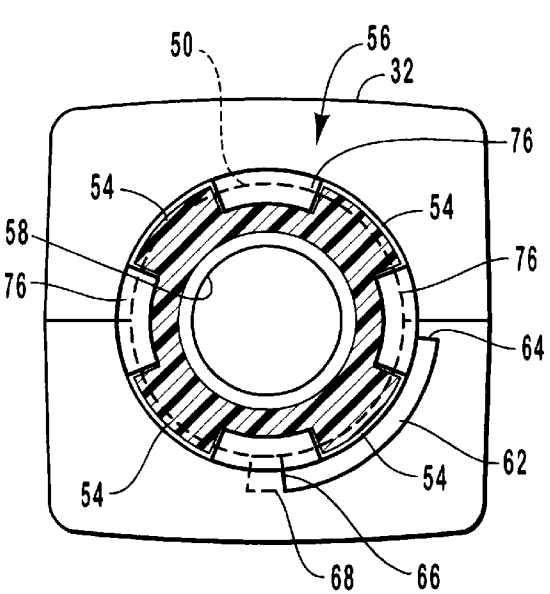
FIG. 4D is a cross-section view taken along lines 4B—4B in FIG. 4, illustrating yet another rotational position.
Figure 4C:
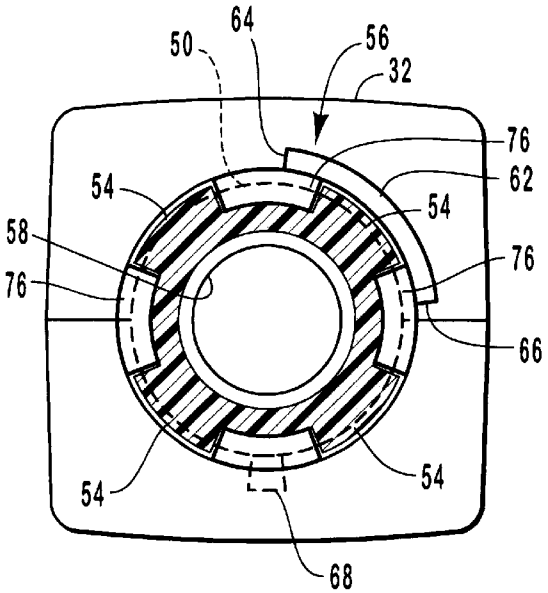
FIG. 4C is a cross-section view taken along lines 4B—4B in FIG. 4, illustrating another rotational position.
Figure 4B:
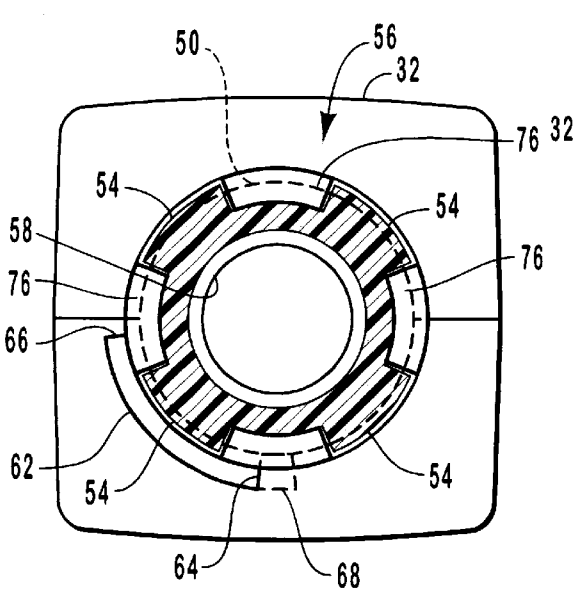
FIG. 4B is a cross-section view taken along lines 4B—4B in FIG. 4, illustrating one rotational position.

FIGS. 4A–4D illustrate one presently preferred example of how the dial index 56 provides the rotation limiting function. As is shown in FIGS. 4A and 4B, as the peripheral interface 21 and the index 56 are rotated in a clock-wise direction a full 270°, the first abutment edge 64 comes into contact with the stop surface 68 so as to prevent further rotation. The assembly can then only be rotated in the other direction, as is shown in FIG. 4C, until the second abutment edge 66 comes into contact with the stop surface 68, as is shown in FIG. 4D. It will be appreciated that the range of rotation can be altered by altering the size of the ridge 62.

In a presently preferred embodiment, the dial index 56 also provides an additional function. In particular, the index 56 provides the user with a tactile "click" feedback when the adapter has been rotated to and is "locked" at predetermined positions, which in the preferred embodiment are 90° increments (such as is shown in FIG. 3).

In the presently preferred embodiment, this function is provided by way of cam surfaces 70 formed on fingers 76 of the index 56, oriented at 90° increments about the index 56. Complementary recesses 78, shaped so as to receive the fingers 76, are formed within the inner surface of the housing 30. As the index 56 is rotated to each 90° position, the fingers 76 are received within a corresponding recess 78, and the index 56 is thus "locked" at that particular position. Moreover, when the position is reached, a clicking effect is provided as a result of the biasing force provided by the spring 72 (or similar biasing structure), thereby indicating to the user that the predetermined rotational position has been reached. Although a locking effect is provided, the index 56 can be rotated to a new position due to the cam surface shape 70 on the fingers 76. The amount of force required to disengage the locked position can be varied by altering the angle of the cam surfaces 70, and/or by varying the level of biasing force provided by the spring 72.

Further, while the illustrated embodiment provides locking positions at 90° increments, any increment can be provided with additional fingers and recesses.

Figure 8:
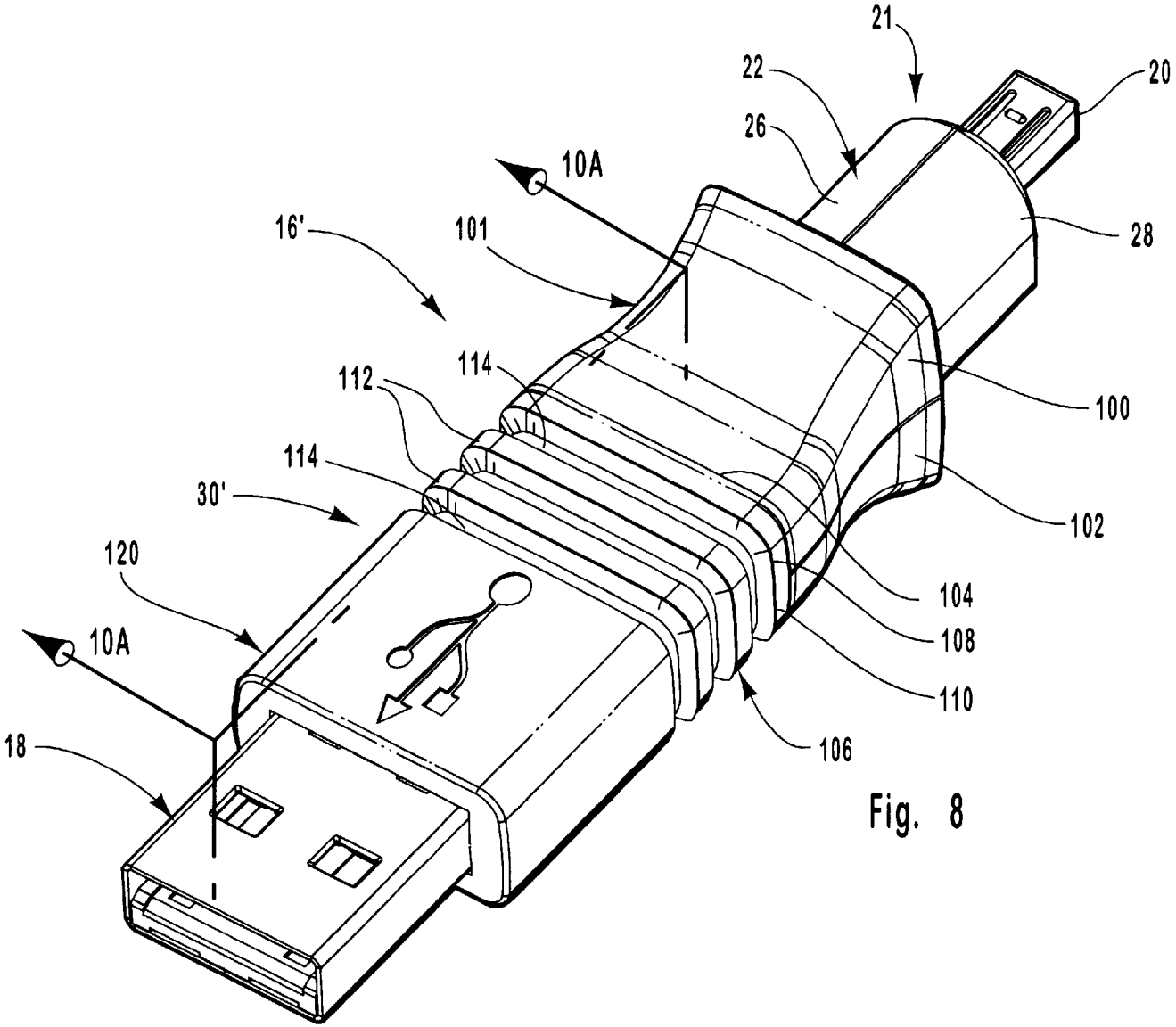
FIG. 8 is a perspective view of yet another embodiment of a connector adapter.

Reference is next made to FIG. 8, which illustrates another presently preferred embodiment of the present invention. This figure illustrates a connector adapter, designated generally at 16', that is similar to the embodiments of FIGS. 2–7 in that the connector adapter 16' allows a peripheral to be oriented in any one of a plurality of physical positions. However, the illustrated connector adapter 16' provides a degree of strain relief along the length of its outer housing. In this way, the adapter is less rigid, and thus is less subject to breakage when subjected to an external force—particularly when it is operatively received within a host port. As noted, this capability is especially useful when the adapter is used to connect to portable devices, such as a laptop or handheld computer, which encounter such forces on an ongoing basis during handling and movement.

As is shown in FIG. 8, in a preferred embodiment the connector adapter 16' includes an outer housing 30'. However, instead of being comprised of a single outer housing that is relatively rigid, the housing 30' is formed so as to provide a level of strain relief along its length. In the illustrated embodiment, this strain relief characteristic provides at least a portion of the outer housing with the capability to bend, or flex, a predetermined distance in any direction. For example, in the embodiment shown, the outer housing 30' is formed as two sections. The first section, designated generally at 101, is formed from a rigid plastic material as previously described (such as polycarbonate or the like), and includes a top 100 and a bottom 102 portion. This first section is connected to the peripheral interface 21, such as that previously described.

A second section of the outer housing 30' is designated at 120. This portion is formed from a non-rigid material such as PVC, or a similarly compliant material that is capable of providing a bending response along the length of this portion of the housing 30'. In the preferred embodiment, this portion 120 is formed as a single integral piece, and is molded over the corresponding interior portion of the connector 16 utilizing techniques known in the art. It is connected to the adjacent portion 101 via an ultrasonic weld, or by any other suitable attachment means. Moreover, in addition to the bending properties provided by the material itself, in a preferred embodiment the overmolded section 120 also provides a degree of strain relief by virtue of the physical geometry of the section 120. For example, in the illustrated embodiment, at least a portion of the length of section 120 is formed with a flex mechanism, designated at 106, that is formed with a series of serrations to provide a strain relief geometry. The serrations include a plurality of ridges 112, separated by corresponding recess portions 114. The number and sizes of the ridges 112/recesses 114 will depend upon the degree of strain relief desired, and can be varied to obtain different bending properties. Also, it will be appreciated that the geometry of the flex mechanism 106 can differ from that shown, and still provide the requisite degree of strain relief. For example, the geometry could be formed with different rib patterns and/or shapes, or even could be provided by varying the thickness of that portion of the overmolded housing 120 to increase its flexibility.

Figure 9:
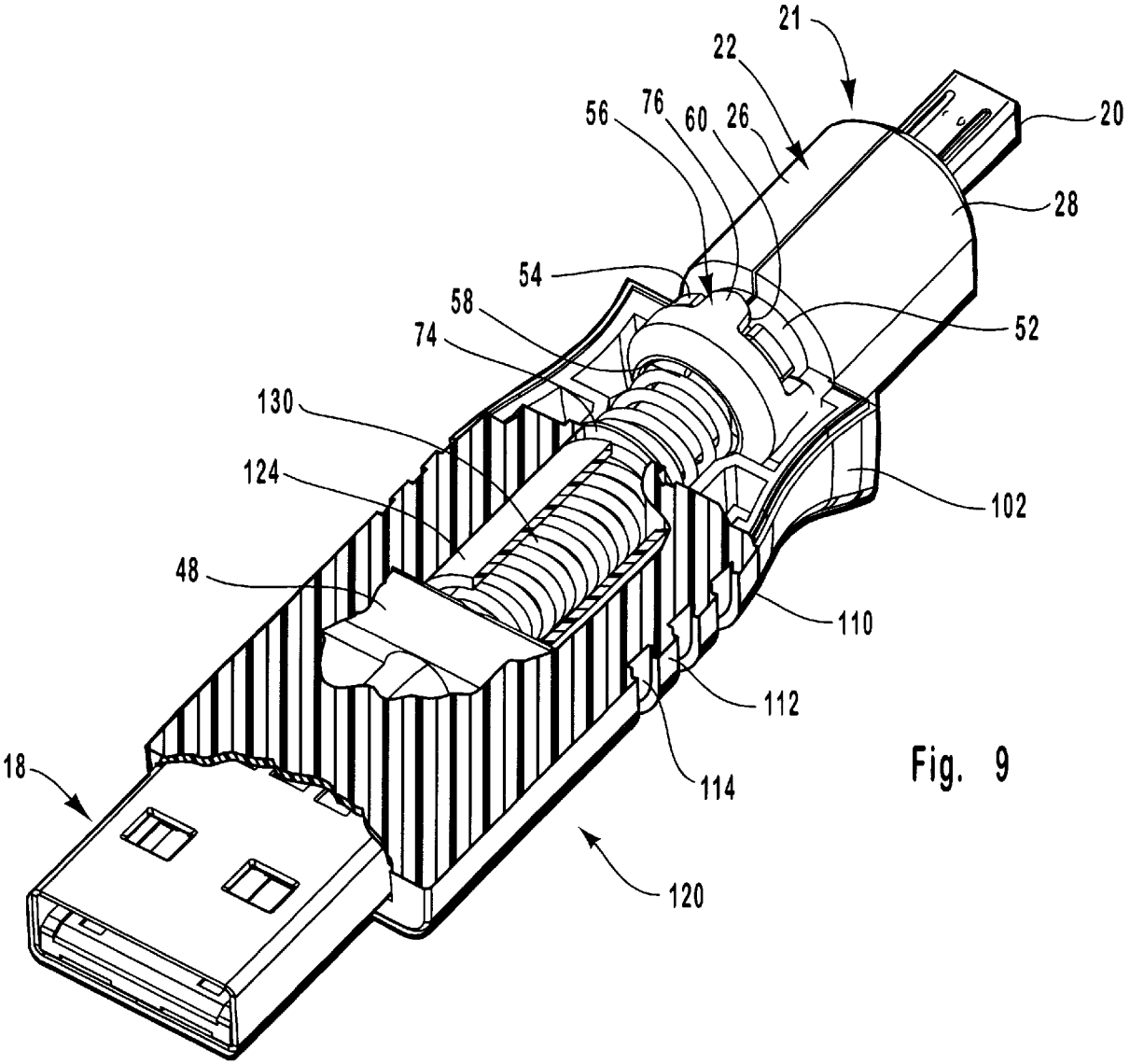
FIG. 9 is a perspective view of a partially assembled connector adapter of FIG. 8.

FIG. 9 illustrates the connector adapter 16' of FIG. 8 and the interior of the housing 30. The internal portion of the adapter 16' is largely the same as that previously described, and that discussion will not be repeated here. However, in one preferred embodiment, the adapter 16' includes means for returning the flexible portion of the housing to an original position when a deflection force is removed. By way of example, this function is provided by way of an extension spring 130, such as is shown in FIG. 9. This spring is positioned along at least a portion of the length of the compliant overmolded section 120. Also, the spring 130 is preferably positioned so as to permit the connector wires 36 to pass through its inner diameter, as is best seen in cross-section in FIG. 10A. The properties of the spring 130 are chosen depending upon the degree of flex required, and upon the flexibility of the housing and the corresponding flex mechanism 106. It is envisioned that the extension spring 130 will have a relatively high outer diameter to wire diameter ratio so as to provide the requisite degree of flexibility. Also, in a presently preferred embodiment a plastic sleeve 124 is disposed about the outer periphery of the spring 130. The plastic sleeve 124 assists the spring 130 in returning the connector to its original position. Also, it prevents any interference between the spring coils and the interior surface of the overmolded portion 120 of the housing.

Figure 10A:
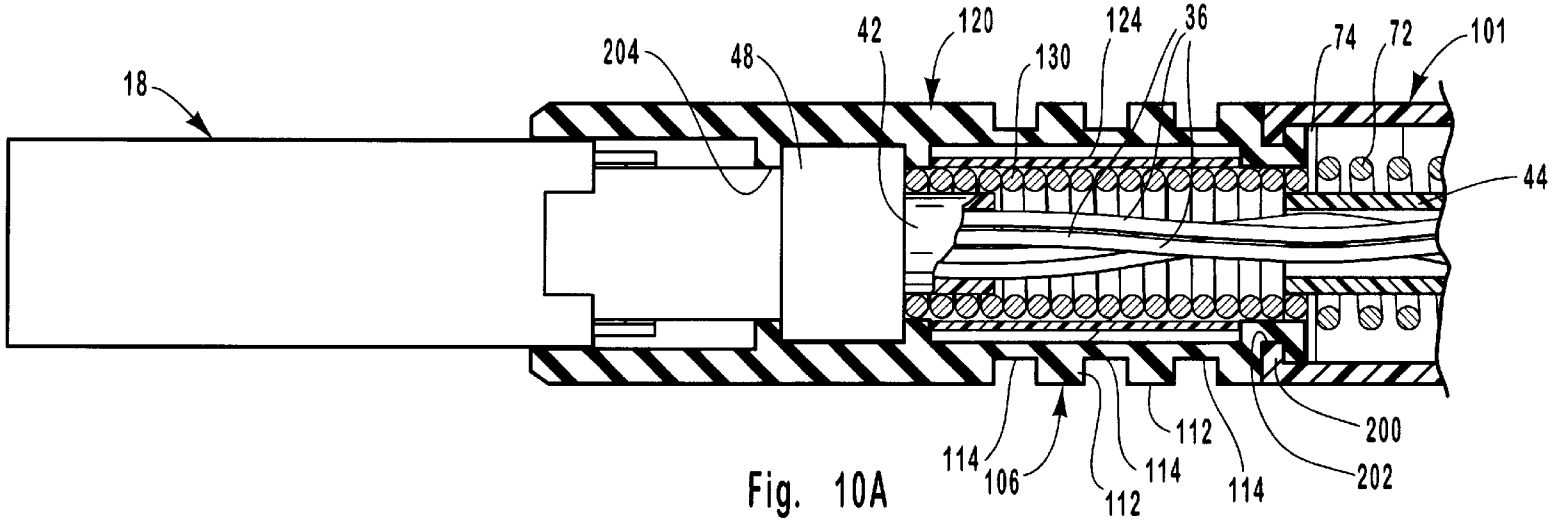
FIG. 10A is a cross-section view of the adapter of FIG. 8 taken along lines 10A—10A in FIG. 8.
Figure 10B:
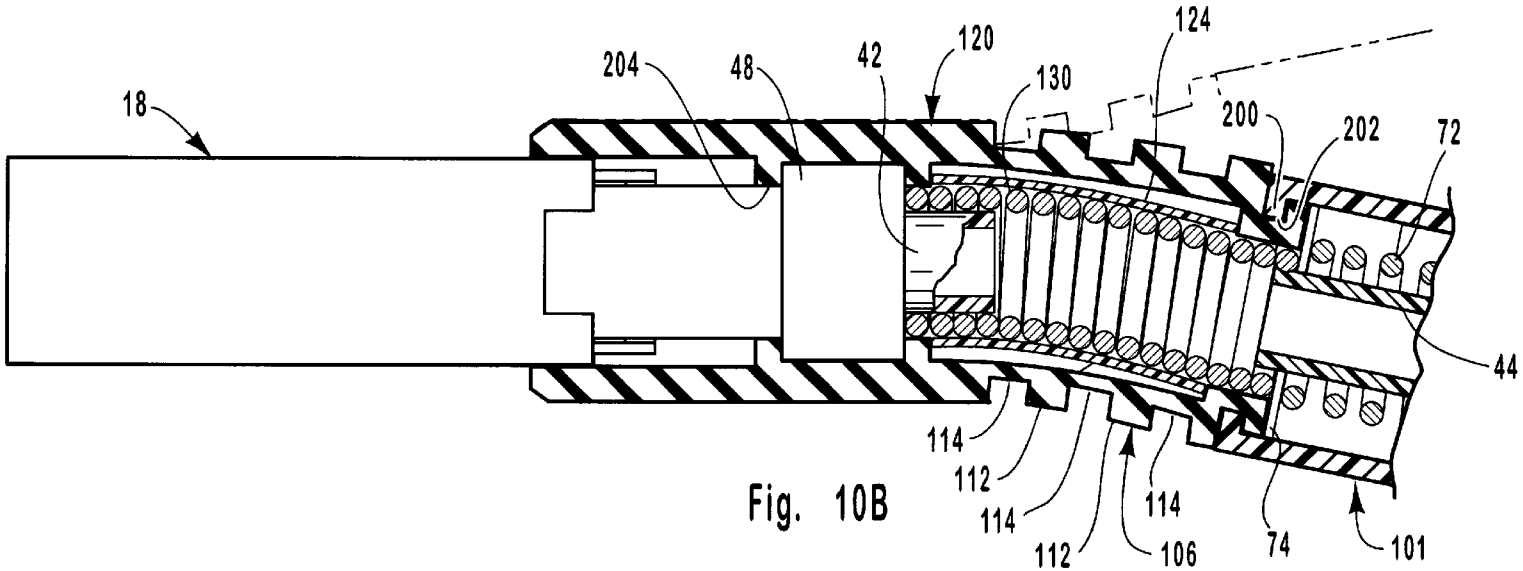
FIG. 10B is a cross-section view of the adapter of FIG. 8 that also represents an example of the bending dynamics provided by the connector adapter.

FIGS. 10A and 10B illustrate the embodiment of FIG. 8 in cross section. As is shown, the second section 120 is joined to the first section 101 to form outer housing 30'. While the two sections can be connected in any appropriate manner, in one preferred embodiment, the end of the first section 101 includes an inwardly projecting ridge 200 that fits within a corresponding recess 202 formed about the periphery of the second section 120. Additional mating ridges/recesses could also be provided to ensure secure attachment. An appropriate adhesive, or sonic weld could be utilized to further secure the two sections so as to form the outer housing 30'. Or, a mechanical clip or similar attachment scheme could be used as the sole means for securing the two sections.

As is also shown, the second section 120 is molded over a portion of the length of the housing of the USB compliant plug 18. Also, a ridge 204 is provided on the inner periphery of the second section 120 to engage with a portion of the outer housing of the plug 18. It will be appreciated that other interlocking schemes could also be used. Also, a suitable adhesive or sonic weld could be used to further secure the two sections.

FIG. 10B also illustrates the manner by which the flex mechanism 106 provides a degree of lateral displacement when an external bending force is applied to the connector adapter 16' and/or to the connected peripheral. As is shown, the flex mechanism 106 is capable of bending in a direction from the central axis of the connector adapter 16', thereby avoiding damage to the adapter 16' and/or the peripheral device. When the external force is removed, the properties of the extension spring 130 and the plastic sleeve 124 will assist in returning the flex mechanism 106 to its original position. Moreover, the internal extension spring 130 and plastic sleeve 124 provides a degree of protection to the electrical wires 36 during any bending of the adapter 16'.

It will be appreciated that while the above discussion has been directed to the description of presently preferred embodiments of the invention, the description should not be construed as limiting of the present invention. For example a notebook computer has been illustrated as one type of host system, but any type of host computing environment could be utilized in connection with the present invention, including other computer system configurations, personal computers, hand-held devices, multi-processor systems, microprocessor-based or programmable consumer electronics, network PCs, minicomputers, mainframe computers, Personal Digital Assistants, digital cameras, and the like.

Moreover, while the present invention has been described in the context of the USB connection system, it would have applicability with any connection scheme that has a specific physical orientation that may not be appropriate for a particular peripheral device. For example, parallel ports, serial ports, RJ-type modular connectors, Firewire connectors and proprietary connection schemes would all find applicability with the present invention.

Also, the present invention is not limited to use with any type of peripheral device. For example, embodiments have been described with respect to an antenna, such as a short range wireless antenna operating under the industry standard know as "Bluetooth." Other antenna peripherals could also be used, as could other types of peripheral devices that may need to be directly connected to the host device and that may require physical reorientation with respect to the host connector interface.

To summarize, embodiments of the present invention are directed to a connector adapter that allows a peripheral to be operatively and directly connected to a host interface, thereby eliminating the need for cables and the like. Moreover, the connector adapter is adjustable, so that the peripheral can be oriented in any one of a plurality of physical positions. Thus, a peripheral, such as an antenna, can be positioned in an optimal orientation, regardless of the physical orientation of the host connection interface. Also, embodiments have been disclosed that provide a level of strain relief to the connector adapter. This strain relief reduces the vulnerability of the connector adapter and peripheral to breakage, in the event that they are subjected to external bending forces. Such strain relief is especially useful when the connector adapter is used on portable computing devices.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed and desired to be secured by U.S. Letters Patent is:

1. A connector adapter for interconnecting a peripheral device to a host device, the adapter comprising:

a first connector, capable of interfacing with a connector on the host device;

a second connector disposed in a spaced-apart arrangement with respect to the first connector, the second connector being capable of interfacing with a connector on the peripheral device, and the second connector being electrically connected to the first connector;

a housing interconnecting the first connector and the second connector in a manner so as to permit rotation of the second connector with respect to the first connector;

wherein at least a portion of the housing is formed from a compliant material that permits the housing to be deflected a predetermined distance; and means for returning the compliant portion of the housing to substantially an original position when a deflection force is removed from the connector adapter.

2. A connector adapter as defined in claim 1, wherein the first connector is a USB-type connector.

3. A connector adapter as defined in claim 1, wherein the peripheral device is an antenna.

4. A connector adapter as defined in claim 1, further comprising a rotation limiting mechanism that limits the degree of rotation between the second connector and the first connector.

5. A connector adapter as defined in claim 1, further comprising a locking mechanism that defines a plurality of rotational positions between the second connector and the first connector.

6. A connector adapter as defined in claim 1, wherein the return means is comprised of an extension spring disposed within the housing.

7. A connector adapter as defined in claim 1, further comprising a flex mechanism formed along at least a portion of the housing that is comprised of the compliant material, the flex mechanism having a physical geometry that provides a predetermined level of strain relief to the housing.

8. A connector adapter as defined in claim 7, wherein the flex mechanism is comprised of a plurality of serrations formed on the outer surface of the housing.

9. A connector adapter for interconnecting a peripheral device to a host device, the adapter comprising:

a first connector, capable of interfacing with a connector on the host device;

a second connector, capable of interfacing with a connector on the peripheral device, the second connector being electrically connected to the first connector via a plurality of electrical wires;

a housing interconnecting the first connector and the second connector in a manner so as to permit rotation of the second connector with respect to the first connector;

a flex mechanism formed along at least a portion of the housing, the flex mechanism having a physical geometry that provides a predetermined level of strain relief to the housing so as to permit a bending of the housing a predetermined distance; and an extension spring disposed within the housing, wherein the plurality of electrical wires pass through an inner diameter of the extension spring.

10. A connector adapter as defined in claim 9, wherein at least a portion of the housing is formed from a compliant material that permits the housing to be deflected a predetermined distance.

11. A connector adapter as defined in claim 9, wherein the flex mechanism is comprised of a plurality of ridges and recessed portions formed along an outer surface of the housing.

12. A connector adapter as defined in claim 9, further comprising means for preventing rotation of the second connector with respect to the first connector to a predetermined number of turns.

13. A connector adapter for interconnecting a peripheral device to a host device, the adapter comprising:

a first connector, capable of interfacing with a connector on the host device;

a second connector, capable of interfacing with a connector on the peripheral device, the second connector being electrically connected to the first connector via a plurality of electrical wires;

a housing interconnecting the first connector and the second connector in a manner so as to permit rotation of the second connector with respect to the first connector to a predetermined fixed orientation, and wherein at least a portion of the housing is comprised of a substantially compliant material so as to permit deflection of the housing;

a flex mechanism formed along at least a portion of the housing, the flex mechanism having a physical geometry that provides a predetermined level of strain relief to the housing so as to permit a bending of the housing a predetermined distance; and an extension spring disposed within an interior cavity of the housing and positioned so as to permit the plurality of electrical wires to pass through an inner diameter of the extension spring.

14. A connector adapter as defined in claim 13, further comprising a rotation limiting mechanism that limits the degree of rotation between the second connector and the first connector.

15. The connector adapter as recited in claim 13, wherein the first and second connectors are disposed in a spaced-apart arrangement with respect to each other.

16. The connector adapter as recited in claim 13, wherein the first and second connectors are disposed in a spaced-apart arrangement with respect to each other.

* * * * *